United States Patent [19]

Smith et al.

[11] Patent Number: 5,071,821

[45] Date of Patent: Dec. 10, 1991

[54] THERMAL RECORD MATERIAL

[75] Inventors: Vivienne J. Smith; Debra J. Clark; Keith B. Damarell, all of Lincoln, England

[73] Assignee: The Wiggins Teape Group Limited, Basingstoke, England

[21] Appl. No.: 458,611

[22] PCT Filed: May 22, 1989

[86] PCT No.: PCT/GB89/00558

§ 371 Date: Jan. 19, 1990

§ 102(e) Date: Jan. 19, 1990

[87] PCT Pub. No.: WO89/11394

PCT Pub. Date: Nov. 30, 1989

[30] Foreign Application Priority Data

May 20, 1988 [GB] United Kingdom ..... 8811965

[51] Int. Cl.[5] ..... B41M 5/30

[52] U.S. Cl. ..... 503/208; 427/150; 503/209; 503/216; 503/225

[58] Field of Search ..... 427/150–152; 503/208, 209, 216, 225

[56] References Cited

U.S. PATENT DOCUMENTS

| | | | |
|---|---|---|---|
| 4,470,057 | 9/1984 | Glanz | 503/209 |
| 4,535,347 | 8/1985 | Glanz | 503/208 |
| 4,586,061 | 4/1986 | Glanz | 503/216 |
| 4,786,629 | 11/1988 | Kawakami et al. | 503/200 |
| 4,794,102 | 12/1988 | Petersen et al. | 503/209 |

*Primary Examiner*—Bruce H. Hess

*Attorney, Agent, or Firm*—Burns, Doane, Swecker & Mathis

[57] ABSTRACT

Thermally sensitive record material (thermal paper) using 2,2-bis(4-hydroxyphenyl)-4-methylpentane as co-reactant with conventional electron donating chromogenic compounds and a combination of a long chain fatty acid amide was melting between 80° and 140° C. and a sensitizer melting between 60° and 120° C. and selected from diaryl ethers, acetoacetic anilides, phenyl hydroxynaphthoates, aryl or aralkyl substituted biphenyls and diaryl carbonates have high thermal sensitivity and good background whiteness.

8 Claims, No Drawings

THERMAL RECORD MATERIAL

This invention relates to thermal mark forming record material, in particular to thermal paper of the general type described, and especially to such record material having improved low temperature reactivity and/or a narrow temperature-energy image formation bandwidth.

Thermal paper in which the image forming components comprise an electron donating chromogenic colour former and an electron accepting (acidic) co-reactant are widely used in facsimile machines and computer printers especially small and/or portable printers. It has long been desirable to reduce the energy requirement for image formation as this can be exploited in increased printing speed and/or lower input power requirements, whilst avoiding undue increase in premature colouration or increased background colouration.

The present invention is based on our finding that a particular combination of co-reactant and (relatively) low melting point compounds gives particularly good results, especially by reducing the energy input requirement, at a given local temperature, required to generate a densely coloured image.

The invention accordingly provides thermally responsive record material comprising a sheet substrate, particularly of paper, having on one surface a mark forming thermally reactive coating comprising a thermographically acceptable binder having dispersed therein finely divided solid particles of:

- at least one electron donating chromogenic compound; 2,2-bis(4-hydroxyphenyl)-4-methylpentane as electron accepting thermal co-reactant;
- a long chain fatty acid amide having a melting point of from 80° C. to 140° C.; and
- a thermal sensitizer having a melting point of from 60° C. to 120° C. and selected from diaryl ethers, acetoacetic anilides, phenyl hydroxynaphthoates, aryl or aralkyl substituted biphenyls, and diaryl carbonates;
- the weight ratio of fatty acid to thermal sensitizer being from 1:10 to 10:1.

The record material includes a substrate or support material which is generally in sheet form. As used herein the term 'sheet' or 'sheets' mean(s) article(s) having two relatively large surface dimensions and a relatively small third (thickness) dimension and includes webs, ribbons, tapes, belts, films and cards. The substrate or support material can be opaque, transparent or translucent and can, itself, be coloured or uncoloured. The material can be fibrous including, for example, paper and filamentous synthetic materials. It can be a film including, for example, cellophane and synthetic polymeric sheets cast, extruded, or otherwise formed. Whilst the particular nature of the substrate material is not especially critical, it is particularly and most commonly of paper.

The long chain fatty acid amide is one having a melting point of from 80° to 140° C., more particularly 90° to 135° C. and is the amide of a $C_{14}$ to $C_{22}$ aliphatic, preferably saturated, fatty acid in particular palmitic, stearic or behenic, but especially stearic, acid. The acid can be substantially pure or, but not particularly preferably, a mixture of such acids as is derived from biological glyceride esters. The amide can be the primary amide as in stearic acid amide, $C_{17}H_{35}CONH_2$, m.pt. 99° C., or an N-alkyl secondary amide in which the alkyl residue is preferably a short chain, especially $C_2$ to $C_4$, group and may form an alkylene bridge between two amide residues as in ethylene-bis-stearamide, $C_{17}H_{35}.CONH.CH_2CH_2.NHOC.C_{17}H_{35}$, m.pt. 130° C.

The sensitizer is an organic aromatic compound having a melting point in the range 60° C. to 120° C., particularly 75° to 110° C., and is selected from diaryl ethers, acetoacetic anilides, phenyl hydroxynaphthoates, aryl or aralkyl substituted biphenyls and diaryl carbonates. Among diaryl ethers, those based on alkanes or alkane ethers such as oxy or polyoxy alkylene ethers, are particularly suitable, especially bis-phenyloxyalkanes, optionally including one or more substituents such as alkyl or alkoxy group(s) or halogen atom(s), e.g. 1,2-diphenoxyethane, m.pt. 94°-96° C., and 1,2-bis(2-methylphenoxy)ethane, m.pt. 85°-86° C. Acetoacetic anilides which can be used in the invention include N-acetoacetylaniline (acetoacetic anilide), m.pt. 83.5° C., 2-methyl-N-acetoacetylaniline (acetoacetic o-toluidine), m.pt. 104°-105° C., and 2-methoxy-N-acetoacetylaniline (acetoacetic o-anisidine), m.pt. 83°-85° C., and among phenyl hydroxynaphthoates, phenyl 1-hydroxy-2-naphthoate, m.pt. 95.5°-96.2° C., is particularly useful. Suitable aryl or aralkyl biphenyls include particularly benzyl substituted biphenyls especially 4-benzylbiphenyl m.pt. 85° C., and a particularly suitable di-aryl carbonate is diphenyl carbonate, m.pt. 78°-80° C.

The fatty acid amide and the sensitizer are used together in a weight ratio of 1:10 to 10:1, particularly 1:3 to 3:1. Use of proportions outside this range does not give the improved narrow temperature-energy image formation bandwidth. We do not fully understand why the combination is effective. However, it seems that the combination has, within the range of proportions given, a relatively constant melting temperature and a narrow melting temperature range for any given pair of materials used and that the melted combined material has sufficient solvent capacity for both the electron donating chromogenic compound and the electron accepting 2,2-bis(4-hydroxy-phenyl)-4-methyl pentane co-reactant to promote the colour forming reaction at relatively lower temperature and/or with less total energy input than when either material is used alone. Suitable electron donating chromogenic compounds, include the well known colour forming compounds, such as phthalides, fluorene spiro lactones, leucauramines, fluorans, spirodipyrans and pyridine and pyrazine chromogenic materials. Suitable phthalides include Crystal Violet Lactone which is 3,3-bis(4'-dimethylaminophenyl)-6-dimethylaminophthalide, as described in U.S. Pat. No. 23,024, phenyl-, indol-, pyrrol-, and carbazol-substituted phthalides as described in U.S. Pat. Nos. 3,491,111, 3,491,112, 3,491,165 and 3,509,174; other suitable phthalides include ethylenyl and bis-ethylenyl phthalides, as described in British Patents Nos. 1492913, 14196296 and 1496297; suitable fluorene spiro lactones include 3,6,6'-tris(dimethylamino)fluorene[9,3]spirophthalide and its homologues as described in European Patent Specification No. 0124377; suitable fluorans include nitro-, amino-, amido-, sulfonamido;, aminobenzylidene-. halo- and anilino-substituted fluorans as described in U.S. Pat. Nos. 3,624,107, 3,627,787, 3,641,011, 3,462,828 and 3,681,390; suitable spirodipyrans include those described in U.S. Pat. No. 3,971,808; and suitable pyridine and pyrazine chromogenic compounds include those described in U.S. Pat. Nos. 3,775,424 and 3,853,869. Specifically suitable chromogenic compounds include: 3-diethylamino-6-methyl-7-anilinofluoran, described in U.S. Pat. No. 3,681,390 and also known as N-102, 3-N-ethyl-N-n-pentylamino-6-methyl-7-anilinofluoran, 3-di-n-butylamino-6-methyl-7-anilinofluoran, 7-(1-ethyl-2-methylindol-3-yl)-7-(4-diethylamino-2-ethoxyphenyl)-5,7-dihydrofuro[3,4-b]pyridin-5-one, described in U.S. Pat. No. 4,246,318, 3-diethylamino-7-(2-chloroanilino)fluoran, described in U.S. Pat. No. 3,920,510, 3-(N-methylcyclohexyamino)-6-methyl-7-anilinofluoran, described in U.S. Pat. No. 3,959,571, 7-(1-octyl-2-methylindol-3-yl)-7-(4-diethylamino-2-ethoxyphenyl)-5,7-dihydrofuro[3,4-b]pyridin-5-one, 3-diethylamino-7,8-benzofluoran, 3,3-bis(1-ethyl-2-methylindol-3-yl)phthalide, 3,3-bis(1-octyl-2-methylindol-3-yl)phthalide, 3-diethylamino-7-anilinofluoran, 3-diethylamino-7-benzylaminofluoran, 3-pyrrolidino-7-dibenzylaminofluoran, 3'-phenyl-7-dibenzylamino-2,2'-spiro-di[2H-1-benzopyran], 3,3-bis(4-dimethylaminophenyl)-6-dimethylaminophthalide and mixtures thereof. 3-diethylamino-6-methyl-7-anilinofluoran is especially preferred as a chromogenic material, particularly when used in combination with other "black" fluoran colour formers such as 3-N-ethyl-N-n-pentylamino-6-methyl-7-anilinofluoran, and 3-di-n-butylamino-6-methyl-7-anilinofluoran.

The binder is a thermographically acceptable binder such as is used in making conventional thermal papers. Suitable binders include especially polyvinyl alcohol and its derivatives. The binder may include materials such as starch, and/or styrene-butadiene rubber latex as co-binder and carboxymethyl cellulose and similar materials as adjuncts.

Whilst the thermally responsive coating in the record material of the invention can be formed just from the binder, chromogenic compounds, co-reactant, fatty acid amide and sensitizer, it will usually include other materials as are commonly used in thermal record material. In particular, the coating can include fillers or pigments such as clays, especially calcined clays, aluminium oxide, aluminium hydroxide, calcium carbonate, both as ground mineral e.g. ground calcite, and as precipitated calcium carbonate, magnesium carbonate, talc, zinc oxide and similar pigments. The pigment is used as an extender, to give good whiteness to the unimaged record material and, particularly when it has good oil absorption, to reduce smudging of the thermal image and build up of the coating on the thermal printing head during use. The coating may also usefully include optical brightening of the unimaged record material, lubricants such as fatty acid salts e.g. zinc stearate, to reduce sticking to thermal printing heads, and paraffin wax which reduces the tendency of the chromogenic material to colour up prematurely and thus improves background whiteness.

The thermally reactive coating will usually be coated on the substrate at a coatweight of from 3 to 10, particularly 5 to 8, g $m^{-2}$. The particular coatweight will vary with the intended end use.

The proportions of the various components used in the thermally reactive coating will typically fall in the following ranges (% by weight based on dry coatweight):

| component | typical % | preferred % |
|---|---|---|
| co-reactant | 5 to 20 | 10 to 15 |
| fatty acid amide | 2 to 20 | 3 to 10 |
| sensitizer | 2 to 20 | 3 to 10 |

-continued

| component | typical % | preferred % |
|---|---|---|
| colour former | 1 to 10 | 15 to 4 |
| binder | 8 to 15 | 11 to 13 |
| *pigment/filler | 30 to 60 | 45 to 55 |
| *optical brightener | up to 0.5 | up to 0.5 |
| *lubricant | up to 5 | 1–2.5 |
| *paraffin wax | up to 2 | about 1 |

*These are optional components but as the filler/pigments, at least, will usually be present, the % figures are based on coatings containing filler/pigment.

The record material of the invention can be made using conventional techniques. Thus, typically the co-reactant and the chromogenic compound will be separately dispersed in aqueous solutions or emulsions of the binder and milled to a particle size in the range 1 to 10 μm e.g. about 2 μm. These separate dispersions will usually be held for a standing time typically of several hours. The fatty acid amide and the sensitizer will be made into dispersions having a particle size of less than 20 μm by milling or emulsifying them. The pigment will usually be supplied as a fine powder, but may require milling, which is dispersed in water normally including some binder. The paraffin wax, if used, is added to the dispersion of the colour former.

The various dispersions are mixed, the lubricant and optical brighteners, if used, can be included in one of the dispersions or on mixing the dispersions, to give a coating mix. The coating mix is coated onto the substrate, dried and is usually calendered to ensure that the coating is smooth.

Process aids such as defoamers and surfactants can be included as needed. Although these will carry over into the dried coating they are not listed above as they are included for process rather than product reasons. Normally they will be used in amount up to 0.5% of the dry coatweight.

The following Examples illustrate the Invention. All parts and percentages are by weight unless otherwise stated.

Examples 1 to 7 are Examples of the invention. Example 1c is a comparative example which uses just a fatty acid amide, with no sensitizer, in a similar formulation to Example 1. Examples 3c and 6c are comparative Examples in which the fatty acid amide-sensitizer combinations used in Examples 3 and 6 respectively are replaced with just the sensitizer in an otherwise very similar coating formulation. In Example 7 a mixture of two black fluoran colour formers was used (see below).

Materials used in Examples co-reactant
2,2-bis(4-hydroxyphenyl)-4-methylpentane
colour former for Examples 1–6, 3c and 6c
3-(N-ethyl-N-3-methylbutylamino)-6-methyl-7-N-phenylaminofluoran
colour former for Example 1c
3-diethylamino-6-methyl-7-N-phenylaminofluoran
colour former mix for Example 7
3-(N-ethyl-N-3-methylbutylamino)-6-methyl-7-N-phenylaminofluoran and 3-diethylamino-6-methyl-7-N-phenylaminofluoran in a weight ratio of 7:3
binder
polyvinyl alcohol as a 15% w/w aqueous dispersion
filler
calcium carbonate (pptd. - particle size ca.3 μm)
fatty acid amide
as in Table 1, used as a 25% w/w aqueous emulsion sensitizer as in Table 1, dispersed and ground as described below.

Preparation of thermally responsive paper

The co-reactant and colour former were each dispersed separately in aqueous dispersion of polyvinyl alcohol binder in proportion of ca. 1 part to 5 parts binder solution. The dispersions were ground in a small media bead mill to a particle size of from 0.5 to 3 μm with an average of ca. 2 μm. Each grind was allowed to stand for several hours. The sensitizer was ground in binder dispersion, at 30% w/w total solids, to a particle size of ca. 2 μm in a bead mill. The co-reactant and colour former grinds were combined, in proportions of ca. 2 parts co-reactant grind: 1 part colour former grind, with high speed mixing and the remaining mix components (including sensitizer grind) added and dispersed in amounts corresponding to the % (dry) figures in Table 1 below.

The coating mixes were coated onto 53 g $m^{-2}$ base paper and dried to give a coatweight of 7 to 8 g $m^{-2}$. The dried coated paper was calendered twice on a laboratory calender at a pressure of 400 pounds weight per linear inch (ca. 7140 kg weight per linear metre) to give the thermally responsive papers of Examples 1 to 7 and comparative Examples 1c, 3c and 6c respectively.

Testing of thermally responsive paper

The thermally responsive papers of Examples 1 to 7 and Comparative Examples 1c, 3c and 6c were tested for Dynamic Sensitivity, Facsimile Image Intensity and Background Whiteness as described below. The results are summarised in Tables 2, 3 and 4 below respectively.

Test Methods

Dynamic Sensitivity

Coated thermally responsive paper was imaged using a FP40 thermal printer controlled by an Epson px4 computer programmed to generate a series of 15×15 mm imaged blocks using a substantially constant imaging temperature (of the thermal print head) but varying the time during which imaging takes place. The imaging temperature was maintained constant by a control loop with an input sensitive to the temperature of the print head and an output controlling the print head driving voltage. In the current tests the imaging temperature was pre-set to ca. 75° C. (other imaging temperatures can be pre-set as needed). In practice, the stability of the temperature is better than the precision with which it can be measured. The imaging time is varied by varying the time (pulse width) for which the print head driving voltage is applied. In testing, pulse widths of from 0.4 to 2.8 ms were used. The image density of the series of imaged blocks was measured using a Macbeth RD914 densitometer. Higher readings correspond to darker images.

Facsimile Image Intensity

Separate samples of thermally responsive paper were imaged using Panafax UF400 and Rank Xerox 7010 Group III facsimile machines. The image printed was of a test chart including a large black area. The density of the image corresponding to the black area was measured using a BNL-2 opacimeter. This opacimeter gives readings as nominal percentage reflectances, thus the lower the figure the darker the image.

Background Whiteness

An unimaged sample of thermally responsive paper was measured using a BNL-2 opacimeter. In considering the results it should be noted that the higher the figure the paler (whiter) the background.

Discussion of test results

The results set out in Tables 2, 3 and 4 below show that the thermally responsive paper of the invention has excellent dynamic sensivitity being superior to the corresponding control comparison Examples which are themselves good; good facsimile image intensity, again superior to the corresponding controls; and excellent background whiteness, being substantially as good as or better than the corresponding controls. Example 2 may appear to give relatively inferior results but it should be noted that using ethylene bis-stearamide as the fatty acid amide gives a thermal paper with an effective imaging temperature higher than that obtained using stearamide. Thus, the dynamic sensitivity test at ca. 75° C. does not show this product to best advantage. It is for this reason that the product of Example 2 was not imaged using the facsimile machines as these work below its best imaging temperature. Similarly comparative Example 1c works with a higher imaging temperature than those employed in the facsimile machines so facsimile test results are not given.

TABLE 1

| | Amounts of materials used in Examples | | | | | | | | | |
|---|---|---|---|---|---|---|---|---|---|---|
| | Example No. | | | | | | | | | |
| Material | 1 | 1c | 2 | 3 | 3c | 4 | 5 | 6 | 6c | 7 |
| co-reactant | 13.4 | 16.25 | 13.97 | 13.4 | 14.47 | 13.4 | 13.4 | 13.4 | 14.47 | 13.4 |
| colour former | 6.72 | 3.42 | 2.6 | 6.72 | 6.05 | 6.72 | 6.72 | 6.72 | 6.05 | 6.72 |
| fatty acid amide | | | | | | | | | | |
| stearamide | 3.02 | 14.41 | — | 3.02 | — | 3.02 | 3.02 | 3.02 | — | 3.02 |
| ethylene-bis-stearamide | — | — | 8.26 | — | — | — | — | — | — | — |
| sensitizer | | | | | | | | | | |
| 4-benzylbiphenyl | 10.38 | — | 3.10 | — | 13.03 | — | — | — | — | 10.38 |
| 1,2-diphenoxyethane | — | — | — | 10.38 | — | — | — | — | — | — |
| phenyl 1-hydroxy-2-naphthoate | — | — | — | — | — | 10.38 | — | — | — | — |
| diphenyl carbonate | — | — | — | — | — | — | 10.38 | — | — | — |
| acetoacetic-o-toluidine | — | — | — | — | — | — | — | 10.38 | 13.03 | — |
| binder | 10.76 | 18.11 | 19.9 | 10.76 | 10.76 | 10.35 | 10.76 | 10.76 | 10.35 | 10.76 |
| filler | 52.52 | 41.95 | 46.05 | 52.52 | 51.60 | 52.52 | 52.52 | 52.52 | 51.60 | 52.52 |
| zinc stearate | 1.99 | 5.63 | 4.89 | 1.99 | 4.29 | 1.99 | 1.99 | 1.99 | 1.99 | 1.99 |
| paraffin wax | 1.0 | — | 1.66 | 1.0 | — | 1.0 | 1.0 | 1.0 | — | 1.0 |
| surfactant | 0.21 | 0.23 | 0.28 | 0.21 | 0.21 | 0.21 | 0.21 | 0.21 | 0.21 | 0.21 |

TABLE 2

| Dynamic Sensitivity Pulse Width (ms) | Dynamic Reactivity Example No. 1 | 1c | 2 | 3 | 3c | 4 | 5 | 6 | 6c | 7 |
|---|---|---|---|---|---|---|---|---|---|---|
| 0.4 | 0.09 | 0.10 | 0.07 | 0.08 | 0.06 | 0.08 | 0.09 | 0.09 | 0.06 | 0.07 |
| 0.6 | 0.17 | 0.11 | 0.09 | 0.21 | 0.13 | 0.12 | 0.29 | 0.15 | 0.13 | 0.18 |
| 0.8 | 0.42 | 0.17 | 0.19 | 0.45 | 0.32 | 0.29 | 0.61 | 0.34 | 0.29 | 0.46 |
| 1.0 | 0.63 | 0.25 | 0.35 | 0.76 | 0.57 | 0.56 | 0.87 | 0.51 | 0.46 | 0.76 |
| 1.2 | 0.84 | 0.36 | 0.53 | 1.03 | 0.80 | 0.71 | 1.13 | 0.83 | 0.68 | 1.09 |
| 1.4 | 0.97 | 0.47 | 0.72 | 1.19 | 0.94 | 0.90 | 1.17 | 0.90 | 0.81 | 1.26 |
| 1.6 | 1.27 | 0.57 | 0.90 | 1.35 | 1.11 | 1.13 | 1.25 | 1.18 | 0.94 | 1.35 |
| 1.8 | 1.35 | 0.64 | 1.01 | 1.40 | 1.21 | 1.13 | 1.37 | 1.25 | 0.99 | 1.39 |
| 2.0 | 1.41 | 0.70 | 1.08 | 1.46 | 1.33 | 1.40 | 1.42 | 1.35 | 1.13 | 1.41 |
| 2.2 | 1.42 | 0.77 | 1.12 | 1.49 | 1.37 | 1.39 | 1.44 | 1.36 | 1.17 | 1.42 |
| 2.4 | 1.45 | 0.91 | 1.19 | 1.49 | 1.41 | 1.44 | 1.44 | 1.43 | 1.24 | 1.44 |
| 2.6 | 1.45 | 0.95 | 1.20 | 1.50 | 1.40 | 1.47 | 1.44 | 1.43 | 1.29 | 1.44 |
| 2.8 | 1.47 | 0.97 | 1.21 | 1.48 | 1.40 | 1.46 | 1.44 | 1.43 | 1.29 | 1.44 |

TABLE 3

| Facsimile Machine | Facsimile Image Intensity Example No. 1 | 3 | 3c | 4 | 5 | 6 | 6c | 7 |
|---|---|---|---|---|---|---|---|---|
| Panafax VF400 | 4.4 | 3.7 | 4.6 | 4.3 | 4.0 | 4.6 | 6.2 | 4.3 |
| Rank Xerox 7010 | 4.3 | 3.8 | 4.6 | 4.6 | 4.1 | 4.6 | 6.8 | 4.2 |

TABLE 4

| Background Whiteness Example No. 1 | 2 | 3 | 3c | 4 | 5 | 6 | 6c | 7 |
|---|---|---|---|---|---|---|---|---|
| 96.1 | 96.5 | 95.1 | 96.0 | 96.0 | 94.8 | 95.8 | 91.5 | 94.2 |

We claim:

1. Thermally responsive record material comprising a paper substrate having on one surface a mark forming thermally reactive coating comprising a thermographically acceptable binder having dispersed therein finely divided solid particles of:

at least one electron donating chromogenic compound;

2,2-bis(4-hydroxyphenyl)-4-methylpentane as electron accepting thermal co-reactant;

a long chain fatty acid amide having a melting point of from 80° C. to 140° C.; and a thermal sensitizer having a melting point of from 60° C. to 120° C. and selected from diaryl ethers, acetoacetic anilides, phenyl hydroxynaphthoates, aryl or aralkyl substituted biphenyls, and diaryl carbonates;

the weight ratio of fatty acid amide to thermal sensitizer being from 1:10 to 10:1.

2. Record material as claimed in claim 1 where the fatty acid amide is one or more $C_{14}$ to $C_{22}$ saturated aliphatic fatty acid amide having a melting point of from 90° to 135° C.

3. Record material as claimed in claim 2 wherein the sensitizer has a melting point of from 75° to 110° C.

4. Record material as claimed in claim 1 wherein the sensitizer has a melting point of from 75° to 110° C.

5. Record material as claimed in claim 4 wherein the sensitizer is 1,2-diphenoxyethane, 1,2-bis(2-methylphenoxy)ethane, N-acetoacetylaniline, 2-methyl-N-acetoacetylaniline, 2-methoxy-N-acetoacetylaniline, phenyl 1-hydroxy-2-naphthoate, 4-benzylbiphenyl or diphenyl carbonate.

6. Record material as claimed in claim 5 wherein the weight ratio of fatty acid amide to sensitizer is 3:1 to 1:3.

7. Record material as claimed in claim 1 wherein the weight ratio of fatty acid amide to sensitizer is 3:1 to 1:3.

8. Thermally responsive record material comprising a sheet substrate having on one surface a mark forming thermally reactive coating comprising a thermographically acceptable binder having dispersed therein finely divided solid particles of:

at least one electron donating chromogenic compound;

2,2-bis(4-hydroxyphenyl)-4-methylpentane as electron accepting thermal co-reactant;

a long chain fatty acid amide having a melting point of from 80° C. to 140° C.; and a thermal sensitizer having a melting point of from 60° C. to 120° C. and selected from diaryl ethers, acetoacetic anilides, phenyl hydroxynaphthoates, aryl or aralkyl substituted biphenyls, and diaryl carbonates;

the weight ratio of fatty acid amide to thermal sensitizer being from 1:10 to 10:1.

* * * * *